US008588639B2

(12) United States Patent
Takahashi et al.

(10) Patent No.: US 8,588,639 B2
(45) Date of Patent: Nov. 19, 2013

(54) FIXING DEVICE AND IMAGE FORMING APPARATUS

(75) Inventors: Yoshiharu Takahashi, Osaka (JP); Toshio Ogiso, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 355 days.

(21) Appl. No.: 12/929,321

(22) Filed: Jan. 14, 2011

(65) Prior Publication Data

US 2011/0188874 A1 Aug. 4, 2011

(30) Foreign Application Priority Data

Jan. 29, 2010 (JP) ..... 2010-018390

(51) Int. Cl.
*G03G 15/20* (2006.01)

(52) U.S. Cl.
USPC ..... 399/70

(58) Field of Classification Search
USPC ..... 399/67, 69, 70
See application file for complete search history.

(56) References Cited

U.S. PATENT DOCUMENTS

| | | | | |
|---|---|---|---|---|
| 6,011,938 | A * | 1/2000 | Toizumi | 399/69 |
| 6,400,923 | B1 | 6/2002 | Fukuda et al. | |
| 6,928,257 | B2 | 8/2005 | Ogiso et al. | |
| 7,136,615 | B2 | 11/2006 | Oohara et al. | |
| 7,142,803 | B2 | 11/2006 | Koyama et al. | |
| 7,167,670 | B2 | 1/2007 | Obata et al. | |
| 7,298,981 | B2 | 11/2007 | Oohara et al. | |
| 7,406,287 | B2 | 7/2008 | Matsumoto et al. | |
| 7,433,640 | B2 | 10/2008 | Yagi et al. | |
| 7,477,867 | B2 | 1/2009 | Hiraoka et al. | |
| 7,634,209 | B2 * | 12/2009 | Tanaka | 399/69 |
| 7,761,044 | B2 | 7/2010 | Yagi et al. | |
| 7,769,332 | B2 | 8/2010 | Yamamoto et al. | |
| 2003/0235422 | A1 * | 12/2003 | Oyaide | 399/69 |
| 2004/0057759 | A1 | 3/2004 | Ogiso et al. | |
| 2005/0254866 | A1 | 11/2005 | Obata et al. | |
| 2006/0008283 | A1 | 1/2006 | Oohara et al. | |
| 2007/0071467 | A1 | 3/2007 | Mitsuya et al. | |
| 2007/0071514 | A1 | 3/2007 | Yagi et al. | |
| 2008/0013993 | A1 | 1/2008 | Obata et al. | |

(Continued)

FOREIGN PATENT DOCUMENTS

| | | | |
|---|---|---|---|
| JP | 60-163102 | A | 8/1985 |
| JP | 3746913 | A | 12/1999 |
| JP | 2008-122757 | A | 5/2008 |

OTHER PUBLICATIONS

Abstract of JP 11-344903 published on Dec. 14, 1999.

*Primary Examiner* — David Gray
*Assistant Examiner* — Gregory H Curran
(74) *Attorney, Agent, or Firm* — Harness, Dickey & Pierce, P.L.C.

(57) ABSTRACT

A fixing device is disclosed, including: a fixing rotative body, a heat source, and a control part. The control part conducts a printing temperature control which varies an ON ratio per unit time of the heat source based on a detection result of the temperature detecting part to maintain a printing target temperature in a printing state, conducts a waiting temperature control which performs an ON/OFF control based on the detection result of the temperature detecting part to maintain a waiting target temperature in a waiting state after a printing operation ends, and conducts a forcible ON control which forcibly turns on the heat source for a predetermined time before starting the ON/OFF control when the detection result of the temperature detecting part after the printing operation ends is lower than the waiting target temperature.

13 Claims, 6 Drawing Sheets

(56) References Cited

U.S. PATENT DOCUMENTS

| | | | | |
|---|---|---|---|---|
| 2008/0056783 | A1 | 3/2008 | Yamamoto et al. | |
| 2008/0069611 | A1 | 3/2008 | Obata et al. | |
| 2008/0226319 | A1 | 9/2008 | Takahashi et al. | |
| 2009/0110418 | A1 | 4/2009 | Ogiso et al. | |
| 2009/0245846 | A1* | 10/2009 | Nakashima | 399/70 |
| 2009/0290893 | A1 | 11/2009 | Ogiso et al. | |
| 2010/0034548 | A1 | 2/2010 | Naitoh et al. | |
| 2010/0054785 | A1 | 3/2010 | Ogiso et al. | |

* cited by examiner

FIXING DEVICE AND IMAGE FORMING APPARATUS

BACKGROUND OF THE INVENTION

1. Field of the Invention

The present invention is related to a fixing device and an image forming apparatus including the fixing device, such as a copier, a printer, or the like using an electro-photographic technology.

2. Description of the Related Art

Conventionally, for example, in an image forming apparatus using an electro-photographic scheme, a toner image is formed on an image carrier, and the toner image is transferred onto a recording medium. After the toner image is transferred, the recording medium is carried to a fixing device, and is heated and pressed by the fixing device, so as to fix the toner image on the recording medium and then eject the recording medium.

In general, as illustrated in FIG. 1, in the fixing device, a fixing belt 52 is set around a fixing roller 53 and a heating roller 54 internally having a heat source 55, and the fixing belt 52 is clipped and pressed by the fixing roller 53 and a pressure roller 51. A paper sheet (recording medium) 59 is passed through between nip parts of the fixing roller 53 and the pressure roller 51. An entry guide 57 is provided to guide the paper sheet 59 to the nip parts at an upstream side above the nip parts formed by the fixing roller 53 and the pressure roller 51, and an output guide 58 for guiding the paper sheet 59 from the nip parts to be ejected is provided at a downstream side. That is, the fixing roller 53 rotates in a direction of an arrow A1 and the fixing belt 52 moves in a direction of an arrow A2. In this case, the pressure roller 51 contacting and pressing the fixing roller 53 through the fixing belt 52 rotates in a direction of an arrow A3. The paper sheet 59 passes through the nip parts by being guided by the entry guide 57 in accordance with a direction of an arrow B, and is carried out from the nip parts by being guided by the output guide 58.

In the fixing device, it is required to assure a capability of stably fixing an image while maintaining a target heating temperature. Conventionally, a technology has been used to control turning on and off the heat source (heater) 55 for heating the heating roller 54 based on a temperature of the fixing belt 52 detected by a temperature detecting part 56. In detail, in a case in which a temperature detected by the temperature detecting part 56 is lower than a target control temperature being a predetermined value, a duty of turning on electricity for the heat source (heater) 55 is set to be 100% and the heat source (heater) 55 is turned on. In a case in which the temperature detected by the temperature detecting part 56 is higher than the predetermined value, the duty of turning on electricity for the heat source (heater) 55 is set to be 0% and the heat source (heater) 55 is turned off. The above-described temperature control scheme is called an on/off control scheme which is disclosed by Japanese Patent No. 3746913.

In the fixing device applying the on/off control scheme, a temperature ripple with respect to a target control temperature becomes greater. Accordingly, Japanese Laid-open Patent Application No. 60-163102 discloses a PID (Proportional, Integral, and Derivative) control for optimizing multiple parameters depending on deviations of a detected temperature and the target control temperature by combining a control algorithm with proportions, integrals, and derivatives. In the PID control, the duty of turning on electricity to a heater (heat source) varies in a range of 0% through 100%.

On the other hand, an object of Japanese Laid-open Patent Application No. 2008-122757 is to make the temperature ripple smaller and stably shorten a rising time. A control technology is disclosed to vary the duty of turning on electricity to be a value calculated by using a detection result of the temperature detecting part based on a predetermined algorithm.

As described in Japanese Laid-open Patent Application No. 2008-122757, in a fixing device using the PID control alone, the temperature ripple becomes smaller. However, since the PID control frequently turns on and off the heater (heat source) even in a waiting state, energy consumption becomes greater than that of the on/off control.

On the contrary, in a case of switching from the on/off control to the PID control after printing, an overshoot becomes greater due to a temperature inside the fixing part after printing, and it takes time to assure the capability of fixing an output image.

In the above-described conventional fixing device, it is difficult to suppress the overshoot when moving to the waiting state after printing, without making the temperature ripple greater.

SUMMARY OF THE INVENTION

The present invention solves or reduces one or more of the above problems.

In an aspect of this disclosure, there is provided a fixing device including a fixing rotative body configured to fix a toner image onto a recording medium by melting the toner image; a heat source configured to heat the fixing rotative body; a control part configured to control the heat source; and a temperature detecting part configured to detect a temperature of the fixing rotative body; wherein the control part is configured to conduct a printing temperature control which varies an ON ratio per unit time of the heat source based on a detection result of the temperature detecting part to maintain a printing target temperature in a printing state, to conduct a waiting temperature control which performs an ON/OFF control based on the detection result of the temperature detecting part to maintain a waiting target temperature in a waiting state after a printing operation ends, and to conduct a forcible ON control which forcibly turns on the heat source for a predetermined time before starting the ON/OFF control when the detection result of the temperature detecting part after the printing operation ends is lower than the waiting target temperature.

Moreover, an image forming apparatus is configured to include the fixing device.

In another aspect of this disclosure, there is provided a fixing device including a fixing rotative body configured to fix a toner image onto a recording medium by melting the toner image; a heat source configured to heat the fixing rotative body; a control part configured to control the heat source; and a temperature detecting part configured to detect a temperature of the fixing rotative body; wherein the control part is configured to conduct a printing temperature control which varies an ON ratio per unit time of the heat source based on a detection result of the temperature detecting part to maintain a printing target temperature in a printing state, to conduct a waiting temperature control which performs an ON/OFF control based on the detection result of the temperature detecting part to maintain a waiting target temperature in a waiting state after a printing operation ends, to conduct a rotation control which rotates the fixing rotative body for a predetermined time without turning on the heat source, and to conduct a forcible ON control which forcibly turns on the heat source for a predetermined time before starting the ON/OFF control when the detection result of the temperature detecting part after stopping a rotation of the fixing rotative body is lower than the waiting target temperature.

Moreover, an image forming apparatus is configured to include the fixing device.

BRIEF DESCRIPTION OF THE DRAWINGS

In the following, embodiments of the present invention will be described with reference to the accompanying drawings.

DESCRIPTION OF THE PREFERRED EMBODIMENT

In the following, an embodiment according to the present invention will be described with reference to the accompanying drawings.

Figure 1:
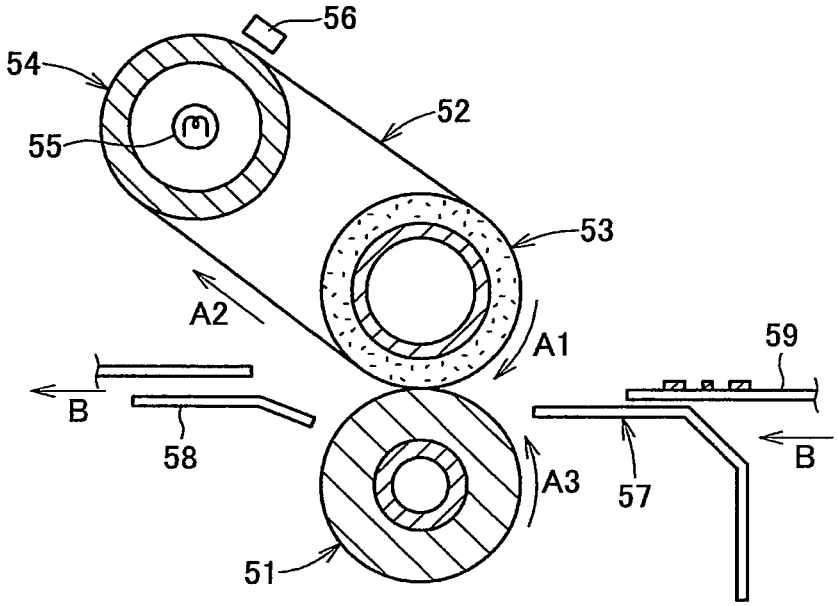
FIG. 1 is a schematic diagram illustrating a fixing device of an image forming apparatus.
Figure 2:
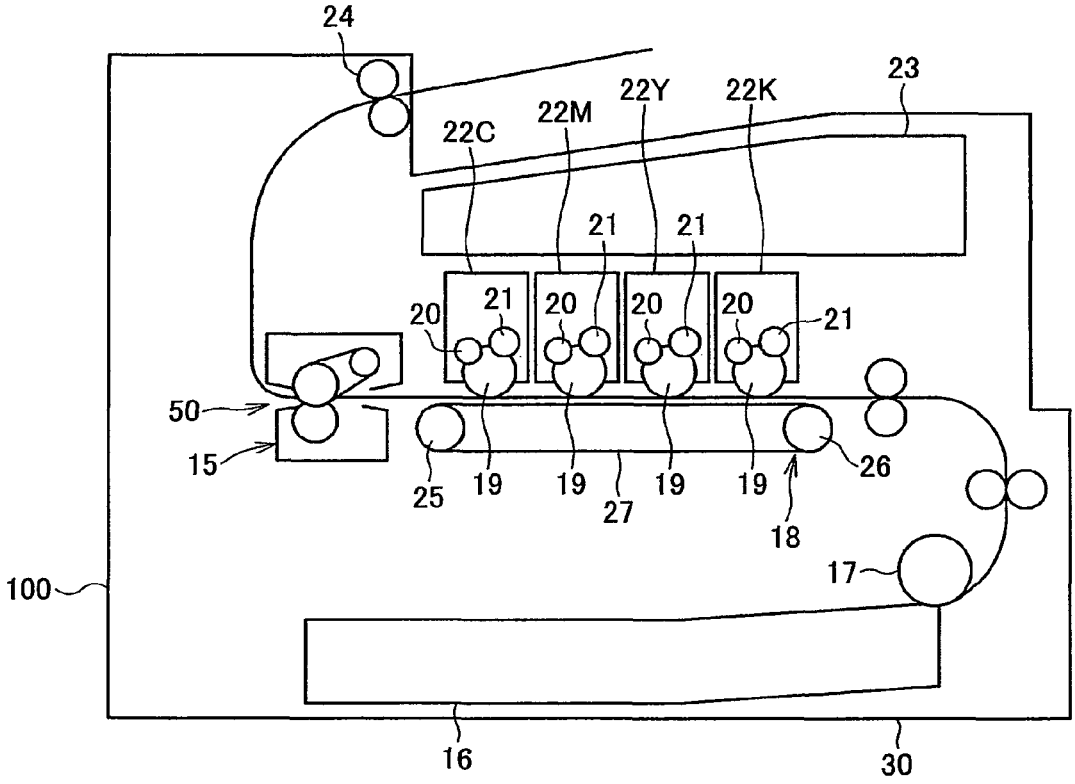
FIG. 2 is a schematic diagram illustrating a configuration of an image forming apparatus according to an embodiment.
Figure 3:
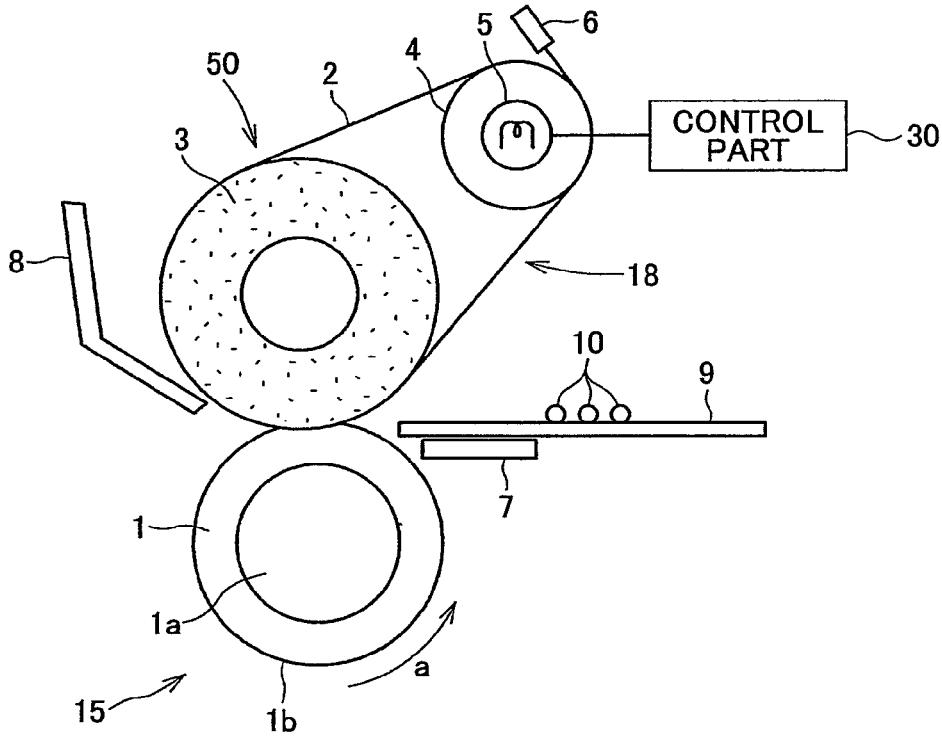
FIG. 3 is a schematic diagram illustrating a fixing device according to the embodiment.

A configuration of an image forming apparatus will be described with reference to FIG. 2 and FIG. 3. FIG. 2 is a schematic diagram illustrating the configuration of the image forming apparatus according to an embodiment. FIG. 3 is a schematic diagram illustrating a fixing device according to the embodiment.

A transfer belt device 18 is arranged at a center in the image forming apparatus 100. Imaging devices 22K for black, 22Y for yellow, 22M for magenta, and 22C for cyan, which are filled with toner, are arranged at a top surface of the transfer belt device 18. In each of the imaging devices 22K, 22Y, 22M, and 22C, a photoreceptor 19, a charging roller 20, and a developing roller 21 are integrally arranged. The transfer belt device 18 includes a pair of support rollers 25 and 26, and an intermediate transfer belt 27 being set around the support rollers 25 and 26. One of the support rollers 25 and 26 functions as a driving roller, and a driving motor (not shown) is connected to a rotation shaft of the driving roller. When the driving motor is driven, the intermediate transfer belt 27 is rotated in a state in which the intermediate transfer belt 27 is set around the support rollers 25 and 26.

An exposure part 23 is arranged at an upper side of the imaging devices 22K, 22Y, 22M, and 22C. A fixing device 15 and a sheet ejection part 24 are arranged downstream of the transfer belt device 18 (at a left side in the image forming apparatus 100 in FIG. 2). A sheet stock part 16 and a sheet feeding part 17 are arranged to stock and feed paper sheets 9 as recording media (in FIG. 3) at a bottom of the image forming part 100.

In this configuration, the charging roller 20 uniformly charges a surface of the photoreceptor 19 for each of the imaging devices 22K, 22Y, 22M, and 22C. Next, information of images and letters supplied by a personal computer and an image scanner is exposed at a dot unit by the exposure part 23, and an electrostatic latent image is formed on the surface of each of the photoreceptors 19. After that, the electrostatic latent image is developed by toner supplied by the developing roller 21 and is visualized as a toner image on each of the photoreceptors 19.

While a toner image is being formed, the paper sheet 9 being a recording medium is conveyed from the sheet stock part 16 to the transfer belt device 18, and sequentially contacts to each of the photoreceptors 19 of the imaging devices 22K, 22Y, 22M, and 22C. Then, toner images for respective colors formed on the photoreceptors 19 are superposed onto the paper sheet 9. That is, a toner image of four colors is formed on the paper sheet 9. The paper sheet 9 on which the toner image is formed is conveyed from the transfer belt device 18 to the fixing device 15, and the toner image is fixed on the paper sheet 9. The paper sheet 9 is ejected outside the image forming apparatus 100 via the sheet ejection part 24.

As illustrated in FIG. 3, the fixing device 15 includes a fixing belt 2 which is driven and rotated by being set around at least two rollers: a fixing roller 3 as a fixing member and a heating roller 4 as a heating member, and a pressure roller 1 as a pressure member for contacting and pressing a surface of the fixing belt 2. In addition, the heating roller 4 includes a heat source 5. Thus, the fixing roller 3, the heating roller 4, and the fixing belt 2 can be collectively called a fixing rotative body 50. The fixing rotative body 50 may include a pressure roller. A temperature of the fixing rotative body 50 (the surface of the fixing belt 2 in this case) is detected by a temperature detecting part 6.

The pressure roller 1 is formed by a core member 1*a* and a coating layer 1*b* for coating the core member 1*a*. For example, the core member 1*a* is a carbon steel core having a 4.5 mm thickness and a 23 mm diameter. The coating layer 1*b* includes a silicon rubber thickness layer, and a PFA (tetrafluoroethylene perfluoroalkyl vinyl ether copolymer resin) layer. The silicon rubber thick layer is 3.5 mm in thickness, and the PFA layer is 30 μm in thickness. The pressure roller 1 presses the paper sheet 9 to the fixing belt 2, rotates in a direction of an arrow a driven by a gear (not shown), and the fixing belt 2 is driven and rotated by a driving force of the pressure roller 1.

For example, the fixing belt 2 is formed of a three layer structure of polyimide, silicon rubber, and PFA (tetrafluoroethylene perfluoroalkyl vinyl ether copolymer resin). Furthermore, in detail, in order to improving an image quality of the toner image and realizing stability of the image quality, a silicone rubber layer having 150 μm thickness as an elastic layer is provided with a surface of a polyimide substrate being an endless belt having 70 μm in thickness and 45 mm in a diameter ϕ. To ensure ease of releasing toner, the PFA of 30 μm thickness is further formed on the silicon rubber provided with the polyimide substrate. The fixing belt 2 is supported by the fixing roller 3 and the heating roller 4.

The fixing roller 3 is arranged at a position facing the pressure roller 1 through the fixing belt 2, and forms a nip part for fixing a toner image 10 formed on the paper sheet 9. The heating roller 4 is a hollow member made of aluminum, iron, or the like, and is arranged to rotatably support the fixing belt 2. In addition, the fixing belt 2 can be stable and conveyed by being rotated at least 100° with respect to the heating roller 4.

As described above, the heat source 5 is arranged inside the heating roller 4. For example, the heat source 5 can be a halogen heater. The halogen heater is connected to a control substrate which forms a control part 30 with a harness. Therefore, the heat source 5 is controlled by the control part 30, and supplies thermal energy necessary to fix the toner image 10 onto the paper sheet 9. For example, the control part 30 includes a micro-computer.

Moreover, for control of the heat source 5 by the control part 30, the temperature detecting part 6 is arranged on the heating roller 4 to face the fixing belt 2. The heat source 5 formed by the halogen heater is controlled based on the temperature detected by the temperature detecting part 6. It should be noted that a contact type thermistor is used for the temperature detecting part 6. Advantageously, by applying the contact type thermistor, an inexpensive configuration can be realized.

Moreover, by arranging the temperature detecting part 6 on the heating roller 4, it is possible to avoid contacting the paper sheet 9. Accordingly, it is possible to reduce damage and malfunctions, and to ensure the temperature detecting part 6 contacts the fixing belt 2. Therefore, it is possible to reduce a temperature error caused by unstable contact, and to improve stability of image quality.

An entry guide 7 is provided at an upstream side above the nip part, which is formed by the pressure roller 1 and the fixing roller 3 which are contacting the paper sheet 9, in a sheet conveyance direction (a moving direction of the fixing belt 2). The paper sheet 9 is guided to the nip part by the entry guide 7. By guiding the paper sheet 9 to the nip part between the pressure roller 1 and the fixing roller 3 with the entry guide 7, movement of the paper sheet 9 can be stable, and the paper sheet 9 can be steadily conveyed. An output guide 8 is arranged at the downstream side below the nip part in the sheet conveyance direction (the moving direction of the fixing belt 2).

Figure 4:
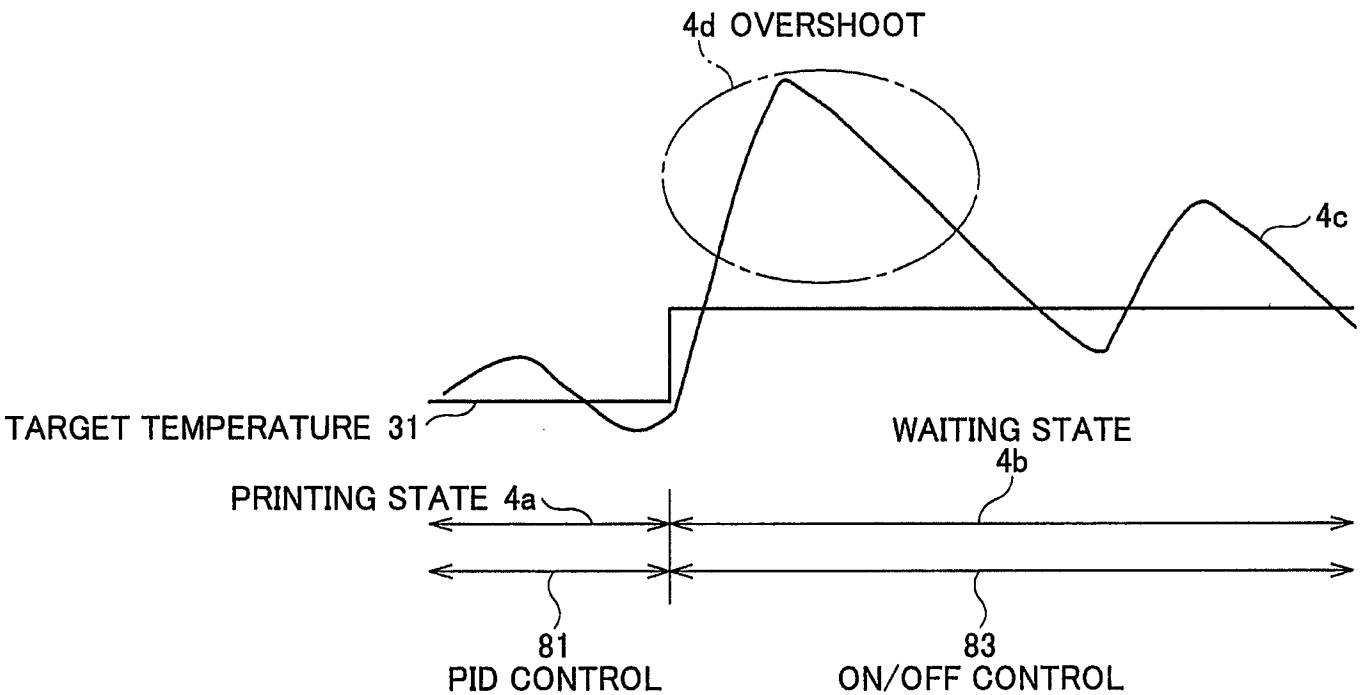
FIG. 4 is a graph showing a relationship between a target temperature and a detected temperature by a temperature detecting part in a printing state and a waiting state.

As illustrated in FIG. 4, in the image forming apparatus 100, there are a printing state (a printing operation) 4*a* and a waiting state 4*b*, and a target temperature 31 is controlled to be different in the printing state 4*a* and in the waiting state 4*b*. With respect to the target temperature 31, based on a detected temperature of the fixing belt 2 by the temperature detecting part 6, a duty of the heat source 5 is controlled by PID (Proportional, Integral, and Derivative) control 81 in the printing state 4*a*, and by an ON/OFF control 83 in the waiting state 4*b*.

The PID control 81 is a control combining P (Proportional), I (Integral), and D (Derivative), and optimizes multiple parameters depending on a deviation between a target value and a current value. In this case, an ON ratio of the heat source 5 for a unit time is varied based on a detection result of the temperature detecting part 6 so as to maintain the target temperature 31 in the printing state 4*a*.

The control part 30 includes a printing state control for varying the ON ratio of the heat source 5 for the unit time based on the detection result of the temperature detecting part 6 so as to maintain the target temperature 31 in the printing state 4*a*, and a waiting state control for conducting the ON/OFF control 83 based on the detection result of the temperature detecting part 6 so as to maintain the target temperature 31 in the waiting state 4*b* after a printing operation ends.

Accordingly, during the printing operation, the multiple parameters are optimized by the PID control 81 being variable control depending on the deviation of a detected temperature and the target temperature 31 by combining P (Proportional), I (Integral), and D (Derivative), and the duty of the heat source 5 is controlled. By this control, it is possible to reduce a temperature ripple and to improve stability of the image quality. It should be noted that the variable control is not limited to the PID control 81 but may be any one of a PI control, an I-PD control, I-P control, and a PI-D control. The PI control is a simplified type of the PID control (=Proportional+Integral+Derivative) and is a control combining Proportional and Integral (Proportional+Integral). The I-PD control is a proportional derivative precedence type control, the I-P control is an integral proportional control, and the PI-D control is a derivative precedence type control.

As illustrated in FIG. 4, an overshoot 4*d* in a temperature waveform 4*c*, which is detected by the temperature detecting part 6 becomes greater when switching the PID control 81 in the printing state 4*a* to the ON/OFF control 83 in the waiting state 4*b* after the printing operation. The PID control 81 supplies heat to the nip part by turning on the heat source 5. During the printing operation, the paper sheet 9 absorbs the heat. However, after the printing operation, the heat remains on the nip part. Also, during the printing operation, both the pressure roller 1 and the fixing roller 3 are rotated to convey the paper sheet 9 as the recording medium. However, these rotations of the pressure roller 1 and the fixing roller 3 are stopped when the printing operation ends. After the rotations are stopped, heat transferred by the rotation in the printing operation is retained in the fixing rotative body 50. Since the above-described control is performed to ensure the capability of fixing the toner image onto the paper sheet 9 as the recording medium, the heat remains in the fixing rotative body 50 even if the heat source 5 is not lighted (is not in an ON state), and a temperature waveform does not become stable. Therefore, an amount of the overshoot 4*d* is varied depending on the number of printed sheets, a printing temperature, a thickness and type of the paper sheet 9, and a print mode.

In the PID control 81, the temperature is always detected, an arithmetic operation is performed by using the detected temperature and the target temperature 31, and the duty of the heat source 5 is determined. Advantageously, the temperature ripple can be reduced. However, since the heat source 5 is frequently turned on and off to maintain a constant temperature, a great amount of energy is consumed. Accordingly, although this operation of turning on and off the heat source 5 is adequate for ensuring the capability of fixing the toner image, in the printing state 4*a*, the operation is inadequate in the waiting state 4*b*. Thus, in the waiting state 4*b*, the ON/OFF control 83 is conducted to turn on the heat source 5 when the temperature is lower than the target temperature 31, and to turn off the heat source 5 when the temperature is higher than the target temperature 31. Therefore, it is possible to reduce energy consumption.

In this case, a change of the control is performed simultaneously when the printing state 4*a* is transferred to the waiting state 4*b*. However, there is a problem in which the overshoot 4*d* in the temperature waveform 4*c* becomes greater when the change of the control is performed. This problem is caused in a first case in which the target temperature 31 in the printing state 4*a* is higher than the target temperature 31 in the waiting state 4*b* and in a second case in which the target temperature 31 in the printing state 4*a* is lower than the target temperature 31 in the waiting state 4*b*. Hereinafter, the target temperature 31 in the printing state 4*a* is called a printing temperature, and the target temperature 31 in the waiting state 4*b* is called a waiting temperature. The second case will be briefly described.

First, the printing temperature is set for each of print modes for respective paper types and paper grammage. Since energy necessary to fix the toner image 10 onto the paper sheet 9 is different for each paper type, the printing temperature is set to be different for each paper type to apply appropriate energy, so as to print an image with a stable quality.

As one example of the print modes, a thin paper mode is applied to the paper sheet 9 having the paper grammage of 60 g/m$^2$ to 65 g/m$^2$, and the printing temperature is 150° C. for the thin paper mode. A regular paper mode is applied to the paper sheet 9 having the paper grammage of 66 g/m$^2$ to 74 g/m$^2$, and the printing temperature is 160° C. for the regular paper mode. A middle thickness mode is applied to the paper sheet 9 having the paper grammage of 75 g/m$^2$ to 90 g/m$^2$, and the printing temperature is 170° C. for the middle thickness mode. Also, the waiting temperature is 160° C. so that time required to change from the waiting state 4*b* to the printing state 4*a* is made to be shorter. Accordingly, the first case in which the printing temperature is higher than the waiting temperature corresponds to the printing operation in the middle thickness mode. In this case, the printing temperature is 170° C. and the waiting temperature is 160° C. Thus, the printing temperature is higher than the waiting temperature. The second case in which the printing temperature is lower than the waiting temperature corresponds to the printing operation in the thin paper mode. In this case, the printing temperature is 150° C. and the waiting temperature is 160° C. Thus, the printing temperature is lower than the waiting temperature.

Figure 5:
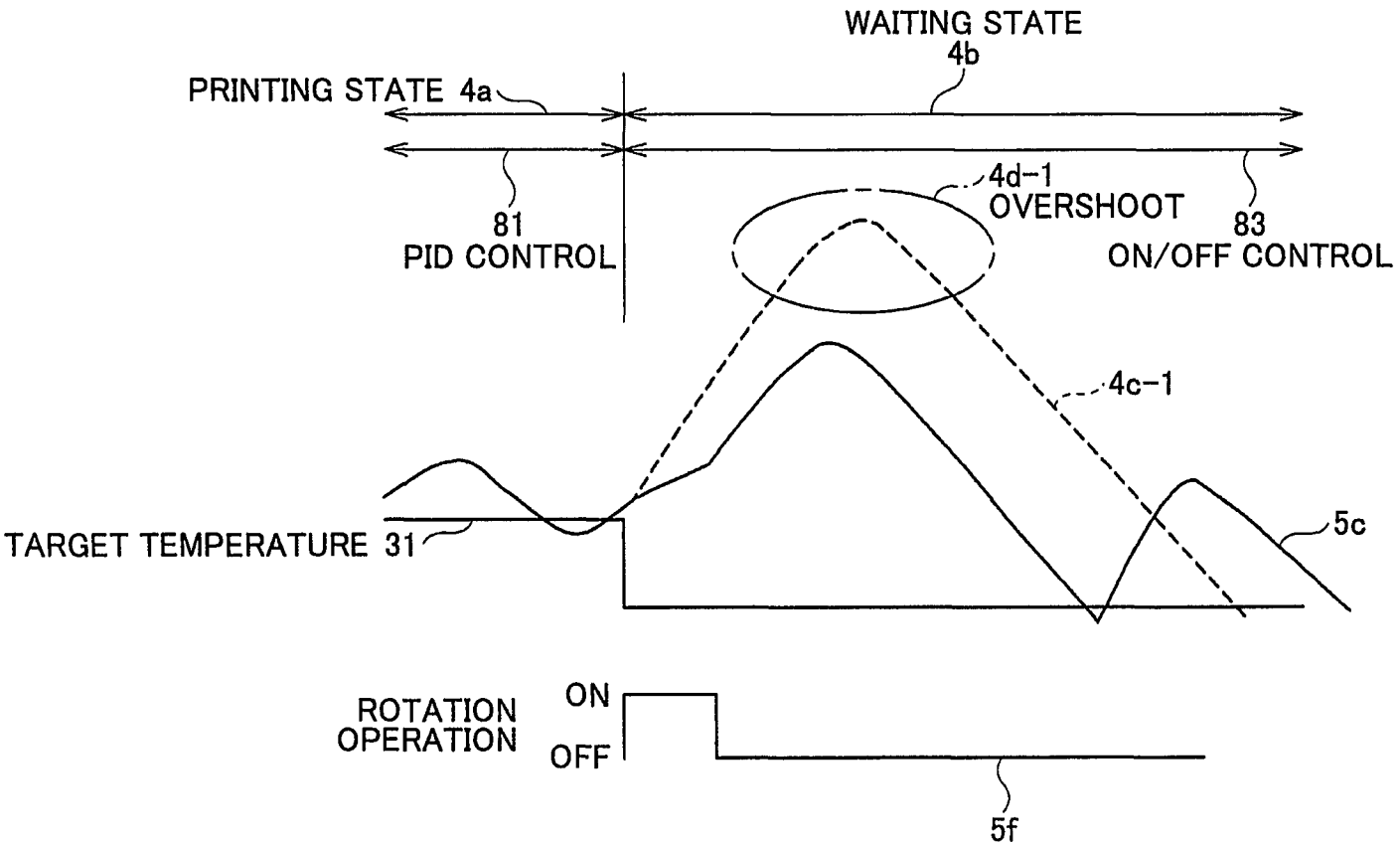
FIG. 5 is a graph showing a relationship between the target temperature and the detected temperature by the temperature detecting part in the printing state and the waiting state, and a relationship between an ON state and an OFF state of a fixing rotative body, in a case in which a printing temperature is higher than awaiting temperature.

Next, as illustrated in FIG. 5, the first case in which the printing temperature is higher than the waiting temperature will be described. In the printing state 4*a*, heat is accumulated in the fixing rotative body 50, and the overshoot 4*d* becomes greater. The overshoot 4*d*-1 is indicated by a dashed circle in FIG. 5. When the control is changed from the PID control 81 to the ON/OFF control 83 after the printing operation, the temperature is higher than the target temperature 31. The heat source 5 as the heater is turned off and is in the waiting state 4*b*. However, if the overshoot 4*d*-1 is greater, it takes time to reduce the temperature. If a print request is made, it is required to wait until the temperature is reduced, and the image forming apparatus 100 is an unavailable apparatus. Moreover, if the temperature becomes extremely high, components may be damaged, and life durations of components may be shorter due to repetitive occurrences of high temperature.

Accordingly, the fixing rotative body 50 is rotated in a certain time after the printing operation to transfer the heat. As illustrated in FIG. 5, a temperature waveform 4*c*-1 depicted by a dashed line including the great overshoot 4*d*-1 can be reduced to be a temperature waveform 5*c* depicted by a solid line. Instead of providing an additional component, the above-described method of rotating the fixing rotative body 50 inexpensively overcomes the above-described problem by a simple control operation. In FIG. 5, a rotation operation 5*f* of the fixing rotative body 50 for reducing the overshoot 4*d*-1 is illustrated corresponding to the temperature waveform 5*c*.

After the printing operation by the fixing rotative body 50, a rotation time is set to be 5 sec. If an idle rotation time is set to be longer, the overshoot 4*d*-1 can be reduced. However, in a case in which a print amount is small and the heat has not accumulated, the temperature is greatly decreased. In this case, the rotation time is set so that the temperature of the fixing belt 2 can be reduced by 10° C. after 10 paper sheets are printed, with respect to a temperature difference 10° C. between 170° C. and 160° C., until the waiting temperature after printing in the middle thickness mode is reached. In this configuration, since the rotation time required to decrease the temperature of the fixing belt 2 by 10° C. is approximately 5 sec, the idle rotation time is set to be 5 sec.

Figure 6:
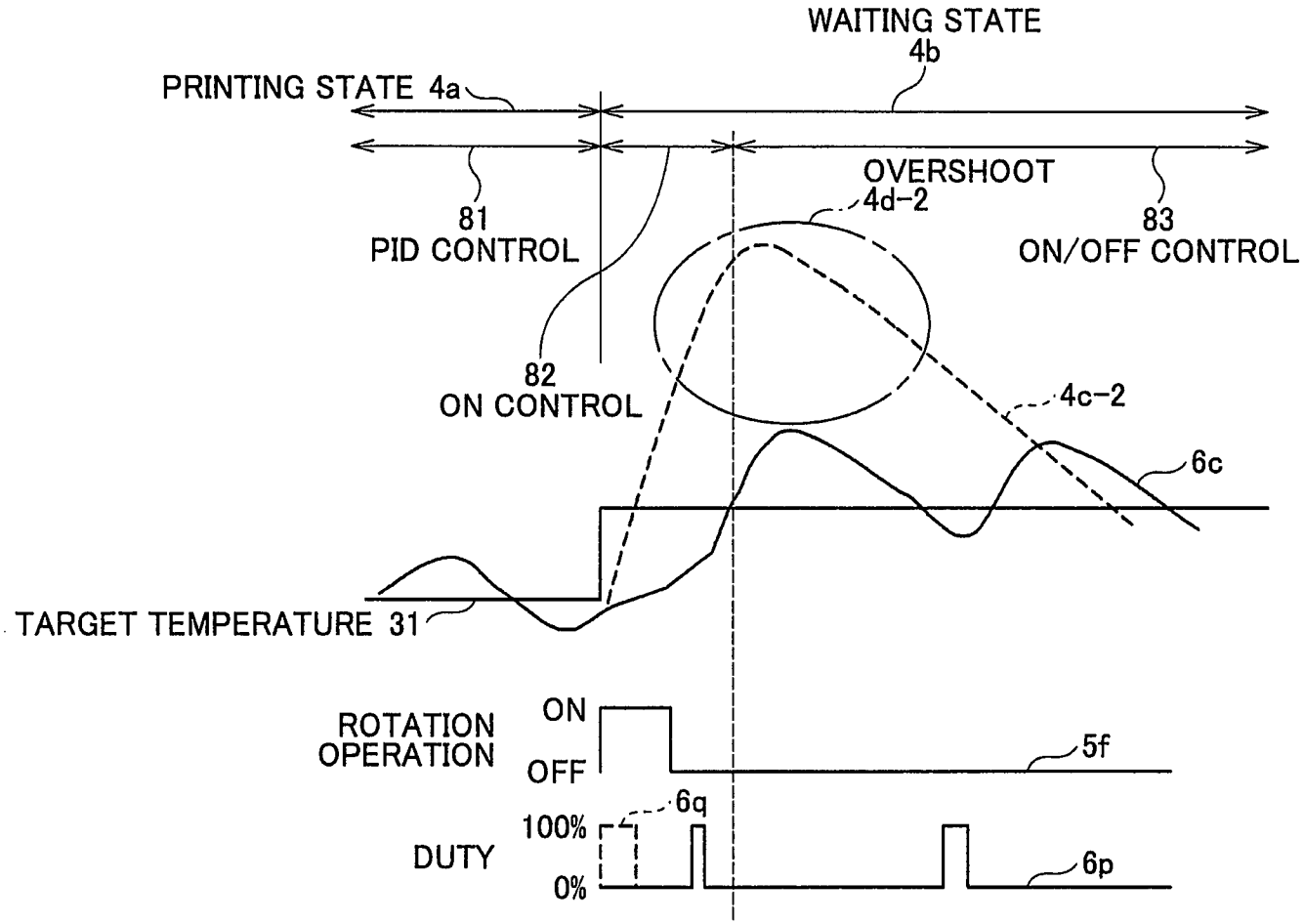
FIG. 6 is a graph showing a relationship between the target temperature and the detected temperature by the temperature detecting part in the printing state and the waiting state, and a relationship between the ON state and the OFF state of the fixing rotative body, in a case in which the printing temperature is lower than the waiting temperature.

Next, the second case in which the printing temperature is lower than the waiting temperature will be described with reference to FIG. 6. In FIG. 6, a temperature waveform 4*c*-2 including a great overshoot 4*d*-2, which is depicted by a dashed line, appears in a case in which the heat source 5 is lighted (in an ON state) when the temperature is lower than the waiting temperature immediately after the control is changed. In this case, the heat source 5 retains the ON state until the temperature reaches the target temperature 31. Thus, the great overshoot 4*d*-2 is caused. A duty portion 6*q* in this case is illustrated corresponding to the great overshoot 4*d*-2 of the temperature waveform 4*c*-2 in a duty 6*p* of the heat source 5 which is depicted corresponding to a temperature waveform 6*c*.

As described above, in order to reduce the great overshoot 4*d*-2, a rotation operation 5*f* of the fixing rotative body 50 is performed. The temperature of the fixing belt 2 is lower than the target temperature 31 immediately after switching from the printing state to the waiting state. If the rotation is performed, each of the rollers 4, 3, and 1 is rotated in a state of the heat source 5 being turned on. Accordingly, the above-described operation is performed to release the heat and reduce the overshoot 4*d*-2 while receiving the heat. Elevation of the temperature is made to be slowed down. However, the great overshoot 4*d*-2 is caused after the rotation is stopped. During the rotation, the heat source 5 is controlled to be forcibly turned off (0%) independent of the temperature to perform an overshoot control. After successive printing, the temperature of the fixing roller 3 as the fixing member becomes a high temperature, and component service life duration becomes shorter. Even if a print request is made, the printing operation cannot be immediately started, and it takes time to start the printing operation.

Accordingly, between the PID control 81 for the printing state and the ON/OFF control 83 for the waiting state, a rapid elevation of the temperature is suppressed by turning off the heat source 5 and by conducting an idle operation. After that, the rotation is stopped, a turn-on time (an ON period) of the heat source 5 is determined based on an elevation gradient of the temperature in a state of stopping the rotation. Then, an ON control for forcibly turning on the heat source 5 during the determined turn-on time alone is provided between the PID control 81 and the ON/OFF control 83. Therefore, it is possible to suppress the overshoot 4*d*-2 due to the ON/OFF control 83.

A determination of the turn-on time (ON period) of the heat source 5 between the PID control 81 and the ON/OFF control 83 will be described. The idle rotation is conducted to reduce the overshoot 4*d*-2 after the PID control 81 in the printing state 4*a*. After that, an elevation gradient of the temperature of the fixing rotative body 50, which indicates an elevation amount of the temperature per second in a state of stopping the fixing rotative body 50, is measured, and a difference between the target temperature 31 and the detected temperature by the temperature detecting part 6 is determined. Accordingly, a control table as illustrated in the following table 1 is defined beforehand. Based on a relationship between the elevation gradient of the temperature and the difference between the target temperature 31 and the temperature detected by the temperature detecting part 6, the turn-on time (ON period) of the heat source 5 is determined.

TABLE 1

| GRADIENT | TEMPERATURE DIFFERENCE (TARGET TEMPERATURE − DETECTED TEMPERATURE) | | | | |
|---|---|---|---|---|---|
| IN STOP STATE | −20° C.≤ | −20 to −10° C. | −10 to 10° C. | 10 to 20° C. | 20° C.≥ |
| −20° C./s≤ | 2 | 1.5 | 1 | 0.5 | 0.5 |
| −20 to −10° C./s | 1.5 | 1 | 1 | 0.5 | 0 |

TABLE 1-continued

| GRADIENT | TEMPERATURE DIFFERENCE (TARGET TEMPERATURE – DETECTED TEMPERATURE) | | | | |
|---|---|---|---|---|---|
| IN STOP STATE | −20° C.≤ | −20 to −10° C. | −10 to 10° C. | 10 to 20° C. | 20° C.≥ |
| −10 to 10° C./s | 1 | 1 | 1 | 0 | 0 |
| 10 to 20° C./s | 0.5 | 0.5 | 0 | 0 | 0 |
| 20° C./s≥ | 0.5 | 0 | 0 | 0 | 0 |

For example, if the elevation gradient is 5° C. in a range of −10° C./s to 10° C./s and the difference between the target temperature 31 and the detected temperature is −15° C. in a range of −20° C. to 20° C., the turn-on time (ON period) of the heat source 5 as the heater is determined to be 1 sec.

Also, as illustrated in FIG. 6, there is a case in which the target temperature 31 in the waiting state is sufficiently higher than the target temperature 31 in the printing state, the heat is not accumulated inside the fixing rotative body 50 since a few paper sheets 9 are printed, and the target temperature 31 in the waiting state is not achieved even without rotating the fixing rotative body 50 after the printing operation ends. In this case, it is not required to rotate the fixing rotative body 50 even after the printing operation ends. On the contrary, as illustrated in FIG. 5, depending on the paper type of the paper sheet 9 as the recording medium, there is a case in which the target temperature 31 in the waiting state 4*b* is lower than the target temperature 31 in the printing state 4*a*. Accordingly, after the printing operation ends, control is always conducted to rotate the fixing rotative body 50. Therefore, it is possible to reduce the overshoot 4*c*-1 in the first case in which the target temperature 31 in the printing state 4*a* is higher than the target temperature 31 in the waiting state 4*b* in FIG. 5, and it is also possible to reduce the overshoot 4*c*-2 in the second case in which the target temperature 31 in the printing state 4*a* is lower than the target temperature 31 in the waiting state 4*b* in FIG. 6.

In the embodiment, in the printing state 4*a*, the ON ratio per unit time can be varied for the heat source 5 based on the detection result of the temperature detecting part 6. Thus, it is possible to reduce the temperature ripple. Also, in the waiting state 4*b* after the print operation ends, the heat source 5 is turned on when the detected temperature becomes lower than the target temperature 31, and the heat source 5 is controlled not to be turned on when the detected temperature is higher than the target temperature 31.

As described above, in the fixing device 15 according to the embodiment, it is possible to reduce the temperature ripple during the printing state 4*a*. Also, the ON control controls the heat source 5 to turn on when the detected temperature becomes lower than the target temperature 31 in the waiting state 4*b* after the print operation ends, it is possible, and the ON/OFF control 83 controls the heat source 5 not to be turned on when the detected temperature is higher than the target temperature. Therefore, it is possible to reduce energy consumption. Moreover, when the ON/OFF control 83 begins, the detected temperature is higher than the target temperature 31. By switching to the ON/OFF control 83, it is possible to reduce unnecessarily turning on the heat source 5, to decrease the energy consumption, and to reduce wear of components. Therefore, the service life duration of components becomes longer, and the overshoots 4*d*-1 and 4*d*-2 can be reduced.

Moreover, even in a case in which the printing temperature is higher than the waiting temperature, and even in a case in which the printing temperature is lower than the waiting temperature, the overshoots 4*d*-1 and 4*d*-2 can be stably reduced.

Any one of various control methods such as the PID control 81 and the like as the control for varying the ON ratio per unit time can be applied, so that the control part 30 can be realized without being complicated and can perform stable control. In a case of changing the target temperature 31 in the printing state 4*a* depending on the paper type of the paper sheet 9 as the recording medium, a stable printing operation can be realized for the paper sheet 9.

In the image forming apparatus 100 according to the embodiment, the overshoots 4*d*-1 and 4*d*-2 can be reduced when the printing state 4*a* is transitioned to the waiting state 4*b*, and the energy consumption can be decreased.

The image forming apparatus 100 according to the embodiment can be an electro-photographic copier, a laser beam printer, a facsimile, and the like. As the heat source 5, other than the halogen heater, for example, induction heating or a ceramic heater may be used. The temperature detecting part 6 is not limited to a thermistor, and may be a device for detecting temperature using a thermocouple, infrared radiation, or the like. The temperature detecting part 6 can be a contact type or a non-contact type.

The present invention is not limited to the specifically disclosed embodiments, and variations and modifications may be made without departing from the scope of the invention.

The present application is based on the Japanese Priority Patent Application No. 2010-018390 filed on Jan. 29, 2010, the entire contents of which are hereby incorporated by reference.

What is claimed is:

1. A fixing device comprising:

a fixing rotative body configured to fix a toner image onto a recording medium by melting the toner image;

a heat source configured to heat the fixing rotative body;

a control part configured to control the heat source; and a temperature detecting part configured to detect a temperature of the fixing rotative body;

wherein the control part is configured to conduct a printing temperature control which varies an ON ratio per unit time of the heat source based on a detection result of the temperature detecting part to maintain a printing target temperature in a printing state, to conduct a waiting temperature control which performs an ON/OFF control based on the detection result of the temperature detecting part to maintain a waiting target temperature in a waiting state after a printing operation ends, and to conduct a forcible ON control which forcibly turns on the heat source for a predetermined time before starting the ON/OFF control when the detection result of the temperature detecting part after the printing operation ends is lower than the waiting target temperature, and wherein the heat source turned on by the forcible ON control is turned off before the temperature of the fixing rotative body achieves the waiting target temperature.

2. The fixing device as claimed in claim 1, wherein the predetermined time for forcibly turning on the heat source is calculated based an elevation gradient of the temperature of the fixing rotative body and a difference between the detection result of the temperature detecting part and the waiting target temperature, in a state in which the heat source is turned off after the printing operation ends and in a predetermined time in which a rotation of the fixing rotative body is stopped.

3. The fixing device as claimed in claim 1, wherein the printing target temperature is changed depending on a paper type of the recording medium.

4. The fixing device as claimed in claim 1, wherein the printing temperature control for varying the ON ratio per unit time is one of a PID control, a PI control, an I-P control, and a PI-D control.

5. The fixing device as claimed in claim 1, wherein the temperature detecting part is a thermistor.

6. An image forming apparatus including a fixing device, wherein the fixing device comprises:

a fixing rotative body configured to fix a toner image onto a recording medium by melting the toner image;

a heat source configured to heat the fixing rotative body;

a control part configured to control the heat source; and a temperature detecting part configured to detect a temperature of the fixing rotative body;

wherein the control part is configured to conduct a printing temperature control which varies an ON ratio per unit time of the heat source based on a detection result of the temperature detecting part to maintain a printing target temperature in a printing state, to conduct a waiting temperature control which performs an ON/OFF control based on the detection result of the temperature detecting part to maintain a waiting target temperature in a waiting state after a printing operation ends, and to conduct a forcible ON control which forcibly turns on the heat source for a predetermined time before starting the ON/OFF control when the detection result of the temperature detecting part after the printing operation ends is lower than the waiting target temperature, and wherein the heat source turned on by the forcible ON control is turned off before the temperature of the fixing rotative body achieves the waiting target temperature.

7. A fixing device comprising:

a fixing rotative body configured to fix a toner image onto a recording medium by melting the toner image;

a heat source configured to heat the fixing rotative body;

a control part configured to control the heat source; and a temperature detecting part configured to detect a temperature of the fixing rotative body;

wherein the control part is configured to conduct a printing temperature control which varies an ON ratio per unit time of the heat source based on a detection result of the temperature detecting part to maintain a printing target temperature in a printing state, to conduct a wailing temperature control which performs an ON/OFF control based on the detection result of the temperature detecting part to maintain a waiting target temperature in a waiting state after a printing operation ends, to conduct a rotation control which rotates the fixing rotative body for a predetermined time without turning on the heat source, and to conduct a forcible ON control which forcibly turns on the heat source for a predetermined time before starting the ON/OFF control when the detection result of the temperature detecting part after stopping a rotation of the fixing rotative body is lower than the wailing target temperature, and wherein the heat source turned on by the forcible ON control is turned off before the temperature of the fixing rotative body achieves the waiting target temperature.

8. The fixing device as claimed in claim 7, wherein the predetermined time for forcibly turning on the heat source is calculated based an elevation gradient of the temperature of the fixing rotative body and a difference between the detection result of the temperature detecting part and the waiting target temperature, in a state in which the heat source is turned off after the printing operation ends and in a predetermined time in which a rotation of the fixing rotative body is stopped.

9. The fixing device as claimed in claim 7, wherein the printing target temperature is changed depending on a paper type of the recording medium.

10. The fixing device as claimed in claim 7, wherein the printing temperature control for varying the ON ratio per unit time is one of a PID control, a PI control, an I-P control, and a PI-D control.

11. The fixing device as claimed in claim 7, wherein the temperature detecting part is a thermistor.

12. A fixing device comprising:

a fixing rotative body configured to fix a toner image onto a recording medium by melting the toner image;

a heat source configured to heat the fixing rotative body;

a control part configured to control the heat source; and a temperature detecting part configured to detect a temperature of the fixing rotative body;

wherein the control part is configured to conduct a printing temperature control which varies an ON ratio per unit time of the heat source based on a detection result of the temperature detecting part to maintain a printing target temperature in a printing state, to conduct a waiting temperature control which performs an ON/OFF control based on the detection result of the temperature detecting part to maintain a waiting target temperature in a waiting state after a printing operation ends, and to conduct a forcible ON control which forcibly turns on the heat source for a predetermined time before starting the ON/OFF control when the detection result of the temperature detecting part after the printing operation ends is lower than the waiting target temperature, and wherein the predetermined time for forcibly turning on the heat source is calculated based an elevation gradient of the temperature of the fixing rotative body and a difference between the detection result of the temperature detecting part and the waiting target temperature, in a state in which the heat source is turned off after the printing operation ends and in a predetermined time in which a rotation of the fixing rotative body is stopped.

13. A fixing device comprising:

a fixing rotative body configured to fix a toner image onto a recording medium by melting the toner image;

a heat source configured to heat the fixing rotative body;

a control part configured to control the heat source; and a temperature detecting part configured to detect a temperature of the fixing rotative body;

wherein the control part is configured to conduct a printing temperature control which varies an ON ratio per unit time of the heat source based on a detection result of the temperature detecting part to maintain a printing target temperature in a printing state, to conduct a waiting temperature control which performs an ON/OFF control based on the detection result of the temperature detecting part to maintain a waiting target temperature in a waiting state after a printing operation ends, to conduct a rotation control which rotates the fixing rotative body for a predetermined time without turning on the heat source, and to conduct a forcible ON control which forcibly turns on the heat source for a predetermined time before starting the ON/OFF control when the detection result of the temperature detecting part after stopping a rotation of the fixing rotative body is lower than the waiting target temperature, and wherein the predetermined time for forcibly turning on the heat source is calculated based an elevation gradient of the temperature of the fixing rotative body and a difference between the detection result of the temperature detecting part and the waiting target temperature, in a state in which the heat source is turned off after the printing operation ends and in a predetermined time in which a rotation of the fixing rotative body is stopped.

* * * * *